US011062656B2

(12) United States Patent
Lee et al.

(10) Patent No.: US 11,062,656 B2
(45) Date of Patent: Jul. 13, 2021

(54) DISPLAY APPARATUS AND METHOD OF DRIVING DISPLAY USING THE SAME

(71) Applicant: Samsung Display Co., Ltd., Yongin-si (KR)

(72) Inventors: Seungjae Lee, Anyang-si (KR); Soon-Dong Kim, Osan-si (KR); Changnoh Yoon, Seoul (KR); Jun Heyung Jung, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/931,966

(22) Filed: Jul. 17, 2020

(65) Prior Publication Data

US 2021/0027713 A1 Jan. 28, 2021

(30) Foreign Application Priority Data

Jul. 26, 2019 (KR) ..... 10-2019-0091271

(51) Int. Cl.

*G09G 3/3258* (2016.01)
*G09G 3/3291* (2016.01)
*G09G 3/00* (2006.01)

(52) U.S. Cl.

CPC ..... *G09G 3/3258* (2013.01); *G09G 3/035* (2020.08); *G09G 3/3291* (2013.01); *G09G 2310/08* (2013.01); *G09G 2380/02* (2013.01)

(58) Field of Classification Search

CPC .... G09G 3/3258; G09G 3/035; G09G 3/3291; G09G 3/3233

See application file for complete search history.

(56) References Cited

U.S. PATENT DOCUMENTS

2012/0169707 A1* 7/2012 Ebisuno ..... G09G 3/3233 345/212
2019/0019458 A1* 1/2019 Teraguchi ..... H01L 27/3248
2019/0114960 A1 4/2019 Lee et al.

FOREIGN PATENT DOCUMENTS

JP 2011-242587 A 12/2011
KR 10-2014-0078419 A 6/2014
KR 10-2016-0108705 A 9/2016
KR 10-2018-0014386 A 2/2018
KR 10-2019-0030534 A 3/2019

* cited by examiner

*Primary Examiner* — Sardis F Azongha
(74) *Attorney, Agent, or Firm* — Lewis Roca Rothgerber Christie LLP

(57) ABSTRACT

A display apparatus includes: a display panel comprising a gate line, a data line and a plurality of display areas; a gate driver configured to output a gate signal to the gate line; a data driver configured to output a data voltage to the data line; a time sensor configured to sense an operation time of the display panel; and a voltage controller configured to adjust a back gate voltage according to the operation time sensed by the time sensor and the display areas.

20 Claims, 15 Drawing Sheets

DISPLAY APPARATUS AND METHOD OF DRIVING DISPLAY USING THE SAME

CROSS-REFERENCE TO RELATED APPLICATION

This application claims priority to and the benefit of Korean Patent Application No. 10-2019-0091271, filed on Jul. 26, 2019 in the Korean Intellectual Property Office KIPO, the contents of which are herein incorporated by reference in their entireties.

BACKGROUND

1. Field

Aspects of some example embodiments of the present inventive concept relate to a display apparatus and a method of driving a display panel using the display apparatus.

2. Description of the Related Art

Generally, a display apparatus includes a display panel and a display panel driver. The display panel includes a plurality of gate lines, a plurality of data lines, a plurality of emission lines and a plurality of pixels. The display panel driver includes a gate driver, a data driver, an emission driver and a driving controller. The gate driver outputs gate signals to the gate lines. The data driver outputs data voltages to the data lines. The emission driver outputs emission signals to the emission lines. The driving controller controls the gate driver, the data driver and the emission driver.

A foldable display apparatus and a rollable display apparatus having a roll shape have been developed using a maximized flexible characteristic of a flexible display panel.

The foldable display apparatus may have at least two display areas. The display areas may be formed in a single flexible display panel. The display area among the display areas may be inactive depending on a folded status of the foldable display apparatus. Due to the difference of the driving time between active areas compared to inactive areas, there may be a different rate of deterioration in areas that are driven as active areas more often.

For example, a portion of the display panel close to the roll may be more frequently activated than a portion of the display panel far from the roll, which may lead to differences in deterioration due to differences indifference driving time between the portions of the display panel.

The above information disclosed in this Background section is only for enhancement of understanding of the background and therefore the information discussed in this Background section does not necessarily constitute prior art.

SUMMARY

Aspects of some example embodiments of the present inventive concept relate to a display apparatus and a method of driving a display panel using the display apparatus. For example, some example embodiments of the present inventive concept relate to a foldable display apparatus, a rollable display apparatus and a method of driving a display panel using the foldable display apparatus and the rollable display apparatus.

Some example embodiments of the present inventive concept include a display apparatus that may be capable of compensating for differences in the rate or amount of deterioration between different display areas, in order to enhance a display quality of a display panel.

Some example embodiments of the present inventive concept may also provide a method of driving the display panel using the display apparatus.

According to some example embodiments of the present inventive concept, a display apparatus includes: a display panel, a gate driver, a data driver, a time sensor and a voltage controller. The display panel includes a gate line, a data line and a plurality of display areas. The gate driver is configured to output a gate signal to the gate line. The data driver is configured to output a data voltage to the data line. The time sensor is configured to sense an operation time of the display panel. The voltage controller is configured to adjust a back gate voltage according to the operation time sensed by the time sensor and the display areas.

According to some example embodiments, the display areas may include a first display area and a second display area. A pixel in the first display area may include a back gate electrode. A pixel in the second display area may not include the back gate electrode.

According to some example embodiments, the voltage controller may be configured to adjust the back gate voltage according to the operation time and apply the back gate voltage to the back gate electrode in the first display area.

According to some example embodiments, when the operation time increases, the voltage controller may be configured to decrease the back gate voltage applied to the back gate electrode in the first display area.

According to some example embodiments, at least one of the pixels in the first display area may include a first pixel switching element comprising a control electrode connected to a first node, an input electrode connected to a second node and an output electrode connected to a third node, a second pixel switching element comprising a control electrode configured to receive a data write gate signal, an input electrode configured to receive the data voltage and an output electrode connected to the second node, a third pixel switching element comprising a control electrode configured to receive the data write gate signal, an input electrode connected to the first node and an output electrode connected to the third node, a fourth pixel switching element comprising a control electrode configured to receive a data initialization gate signal, an input electrode configured to receive an initialization voltage and an output electrode connected to the first node, a fifth pixel switching element comprising a control electrode configured to receive an emission signal, an input electrode configured to receive a high power voltage and an output electrode connected to the second node, a sixth pixel switching element comprising a control electrode configured to receive the emission signal, an input electrode connected to the third node and an output electrode connected to an anode electrode of an organic light emitting element, a seventh pixel switching element comprising a control electrode configured to receive an organic light emitting element initialization gate signal, an input electrode configured to receive the initialization voltage and an output electrode connected to the anode electrode of the organic light emitting element, a storage capacitor comprising a first electrode configured to receive the high power voltage and a second electrode connected to the first node and the organic light emitting element comprising the anode electrode and a cathode electrode configured to receive a low power voltage.

According to some example embodiments, the sixth pixel switching element may further include the back gate electrode.

According to some example embodiments, the display apparatus may further include a driving controller configured to control a driving timing of the gate driver and a driving timing of the data driver. The driving controller may be configured to divide input image data into a first image data corresponding to the first display area and a second image data corresponding to the second display area. The driving controller may be configured to compensate only the first image data among the first image data and the second image data based on the operation time.

According to some example embodiments, the display areas may further include a third display area adjacent to the second display area. A pixel in the third display area may not comprise the back gate electrode.

According to some example embodiments, the display panel may be a foldable display panel. The first display area may be a first surface of the foldable display panel. The second display area may be a second surface of the foldable display panel.

According to some example embodiments, the display panel may be a rollable display panel. The first display area may be an outermost display area from a roll. The second display area may be closer to the roll than the first display area.

According to some example embodiments, the display areas may further include a third display area adjacent to the second display area. The third display area may be closer to the roll than the second display area.

According to some example embodiments, the display areas may include a first display area and a second display area. Pixels in the first display area may comprise first back gate electrodes connected with each other. Pixels in the second display area may comprise second back gate electrodes connected with each other.

According to some example embodiments, the voltage controller may be configured to adjust a first back gate voltage according to an operation time of the first display area and apply the first back gate voltage to the first back gate electrodes in the first display area. The voltage controller may be configured to adjust a second back gate voltage according to an operation time of the second display area and apply the second back gate voltage to the second back gate electrodes in the second display area. The second back gate voltage may be different from the first back gate voltage.

According to some example embodiments, when the operation time of the first display area increases, the voltage controller may be configured to decrease the first back gate voltage. When the operation time of the second display area increases, the voltage controller may be configured to decrease the second back gate voltage.

According to some example embodiments, the display apparatus may further include a driving controller configured to control a driving timing of the gate driver and a driving timing of the data driver. The driving controller may be configured to divide input image data into a first image data corresponding to the first display area and a second image data corresponding to the second display area. The driving controller may be configured to compensate the first image data based on the operation time of the first display area. The driving controller may be configured to compensate the second image data based on the operation time of the second display area.

According to some example embodiments, the display areas may further include a third display area adjacent to the second display area. Pixels in the third display area may include third back gate electrodes connected with each other.

According to some example embodiments, the display panel may be a foldable display panel. The first display area may be a first surface of the foldable display panel. The second display area may be a second surface of the foldable display panel.

According to some example embodiments, the display panel may be a rollable display panel. The first display area may be an outermost display area from a roll. The second display area may be closer to the roll than the first display area.

According to some example embodiments, the display areas may further include a third display area adjacent to the second display area. The third display area may be closer to the roll than the second display area.

According to some example embodiments according to the present inventive concept, in a method of driving a display apparatus, the method includes: outputting a gate signal to a gate line of the display panel comprising a plurality of display areas, outputting a data voltage to a data line of the display panel, sensing an operation time of the display panel using a time sensor and adjusting a back gate voltage according to the operation time sensed by the time sensor and the display areas.

According to some example embodiments, in the display apparatus and the method of driving the display panel using the display apparatus, a back gate voltage may be applied to some of the display areas or different back gate voltages may be applied to different display areas for the display panel including the plural display areas having different characteristics such as the foldable display panel and the rollable display panel. Thus, differences in the rate or amount of deterioration between the display areas due to the difference of the driving time among the display areas may be compensated so that the display quality of the display panel may be enhanced.

BRIEF DESCRIPTION OF THE DRAWINGS

The above and other features and characteristics of the present inventive concept will become more apparent by describing in more detail aspects of some example embodiments thereof with reference to the accompanying drawings, in which.

DETAILED DESCRIPTION

Hereinafter, aspects of some example embodiments of the present inventive concept will be explained in more detail with reference to the accompanying drawings.

Figure 1:
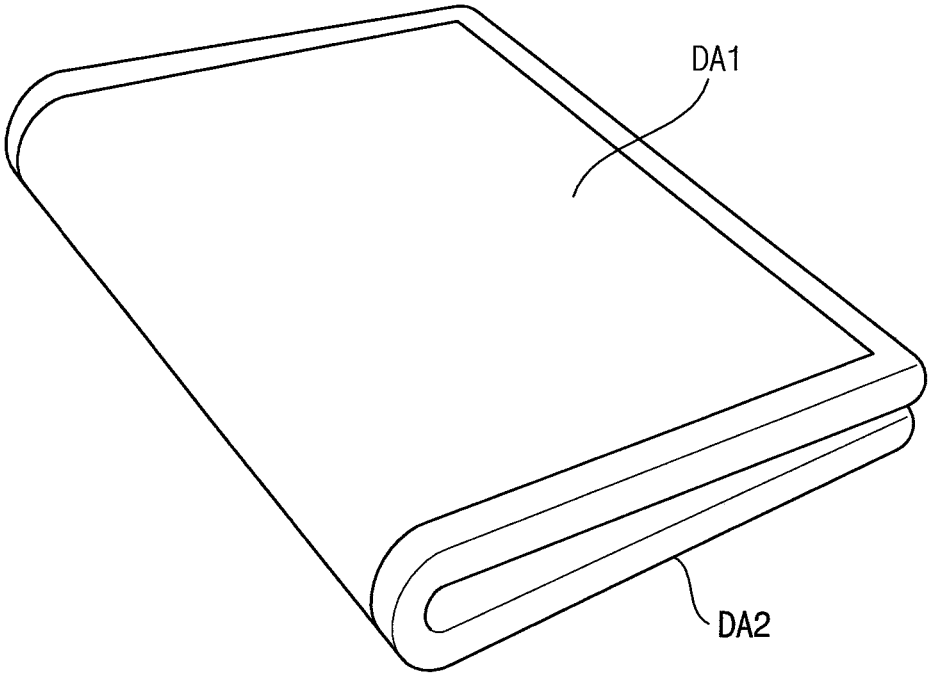
FIG. 1 is a perspective view illustrating a display apparatus according to some example embodiments of the present inventive concept.
Figure 2:
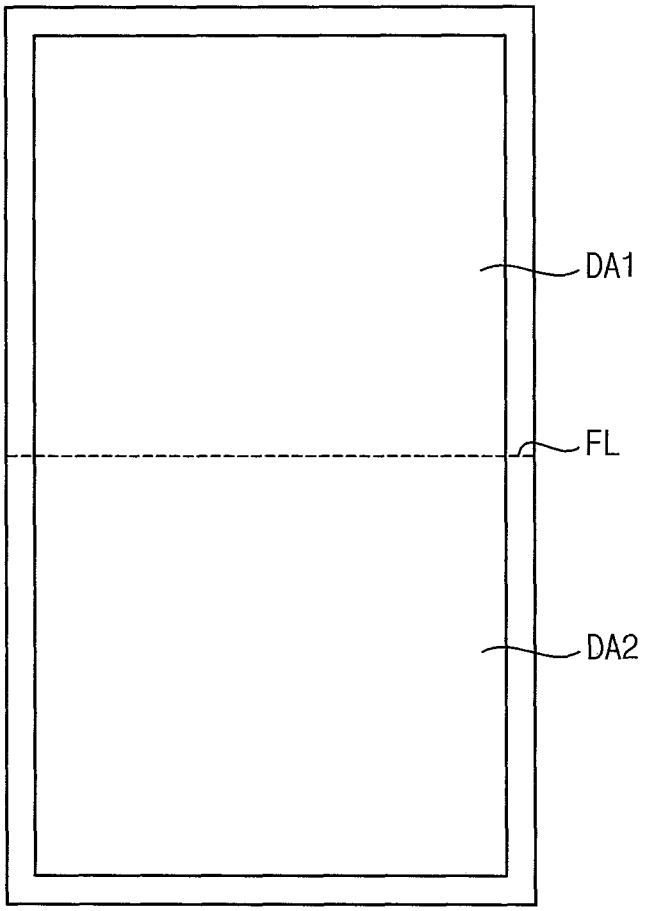
FIG. 2 is a plan view illustrating the display apparatus of FIG. 1.

FIG. 1 is a perspective view illustrating a display apparatus according to some example embodiments of the present inventive concept. FIG. 2 is a plan view illustrating the display apparatus of FIG. 1.

Referring to FIGS. 1 and 2, the display apparatus may include a flexible display panel. The display apparatus may be a foldable display apparatus including a foldable display panel. The display apparatus may be folded along a folding line FL.

The display apparatus may include a first display area DA1 located on a first side of the folding line FL and a second display area DA2 located on a second side of the folding line FL. The first display area DA1 may be a first surface of the foldable display panel. The second display area DA2 may be a second surface of the foldable display panel.

When the display apparatus is folded as shown in FIG. 1, the first display area DA1 may display an image and the second display area DA2 may not display an image. Alternatively, when the display apparatus is folded as shown in FIG. 1, the second display area DA2 may display an image and the first display area DA1 may not display an image according to a user setting. That is, depending on user settings, when the display apparatus is in a folded state, either the first display area DA1, or the second display area DA2 may be in an active state (i.e., configured to display images), and the other display area (from among the first display area DA1 or the second display area DA2) may be in an inactive state (i.e., configured to not display images, or to display a black image).

Figure 3:
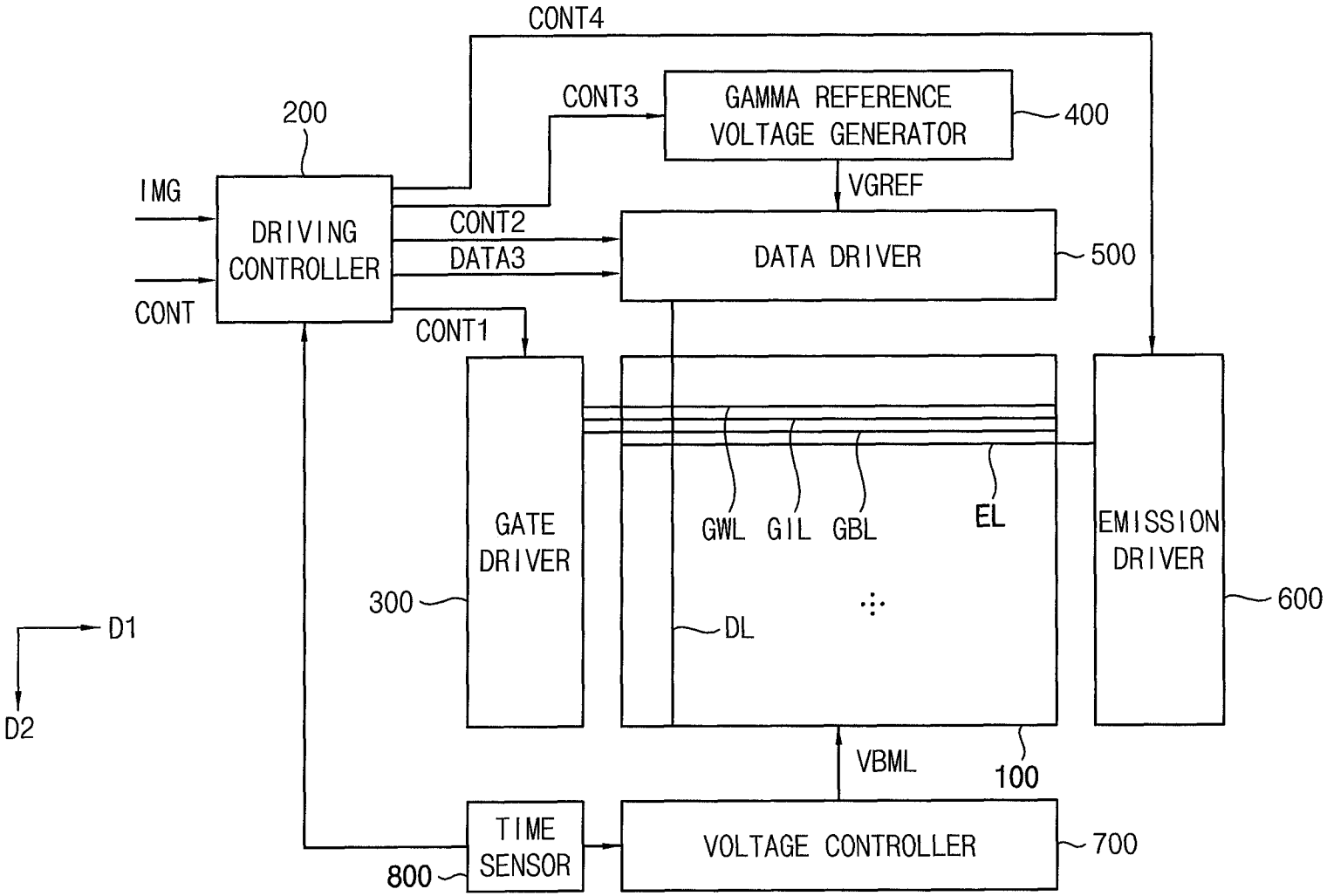
FIG. 3 is a block diagram illustrating the display apparatus of FIG. 1.

FIG. 3 is a block diagram illustrating further details of the display apparatus of FIGS. 1 and 2.

Referring to FIGS. 1 to 3, the display apparatus includes a display panel 100 (comprising a plurality of pixels) and a display panel driver. The display panel driver includes a driving controller 200, a gate driver 300, a gamma reference voltage generator 400, a data driver 500 and an emission driver 600. The display panel driver further includes a voltage controller 700 and a time sensor 800.

For example, the driving controller 200 and the data driver 500 may be integrally formed as a single chip. For example, the driving controller 200, the gamma reference voltage generator 400 and the data driver 500 may be integrally formed as a single chip. For example, the driving controller 200, the gamma reference voltage generator 400, the data driver 500 and the emission driver 600 may be integrally formed as a single chip. For example, the driving controller 200, the gamma reference voltage generator 400, the data driver 500, the emission driver 600 and the voltage controller 700 may be integrally formed as a single chip. For example, the time sensor 800 may be located in the driving controller 200, the data driver 500 or the voltage controller 700.

The display panel 100 has a display region on which an image is displayed and a peripheral region adjacent to the display region.

The display panel 100 includes a plurality of gate lines GWL, GIL and GBL, a plurality of data lines DL, a plurality of emission lines EL and a plurality of pixels electrically connected to the gate lines GWL, GIL and GBL, the data lines DL and the emission lines EL. The gate lines GWL, GIL and GBL extend in a first direction D1, the data lines DL extend in a second direction D2 crossing the first direction D1 and the emission lines EL extend in the first direction D1.

According to some example embodiments, the display panel 100 may include the first display area DA1, the second display area DA2 and a back gate signal applying line connected to back gate electrodes of pixels in the first display area DA1.

The driving controller 200 receives input image data IMG and an input control signal CONT from an external apparatus or external source. For example, the input image data IMG may include red image data, green image data, and blue image data. The input image data IMG may include white image data. The input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GWL, GIL and GBL in response to the first control signal CONT1 received from the driving controller 200. The gate driver 300 may sequentially output the gate signals to the gate lines GWL, GIL and GBL. For example, the gate driver 300 may be integrated on the peripheral region of the display panel 100. For example, the gate driver 300 may be mounted on the peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

According to some example embodiments, the gamma reference voltage generator 400 may be located in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

The voltage controller 700 may output a back gate voltage VBML to the back gate signal applying line. The voltage controller 700 may adjust the back gate voltage VBML according to an operation time sensed by the time sensor 800 and the display areas.

The time sensor 800 may sense the operation time of the display panel 100. According to some example embodiments, the time sensor 800 may sense the operation time of the display area of the display panel 100.

Figure 4:
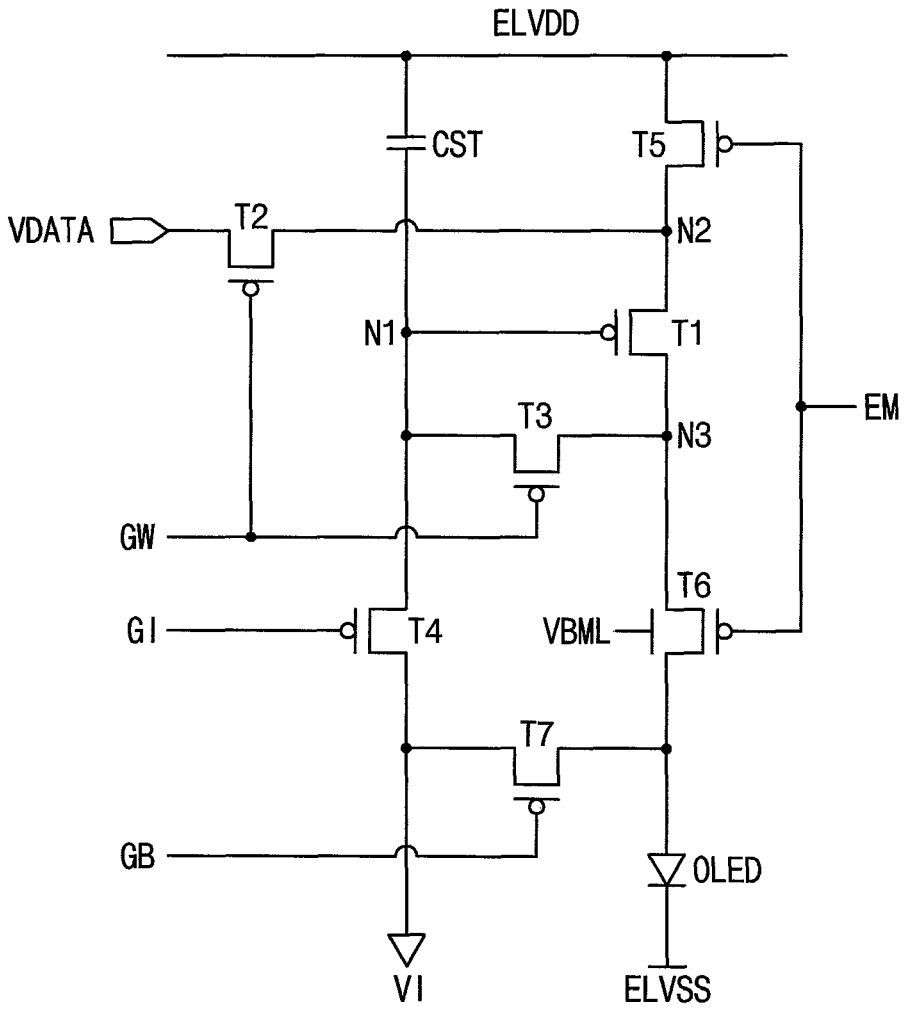
FIG. 4 is a circuit diagram illustrating a pixel of a display panel of FIG. 3.
Figure 5:
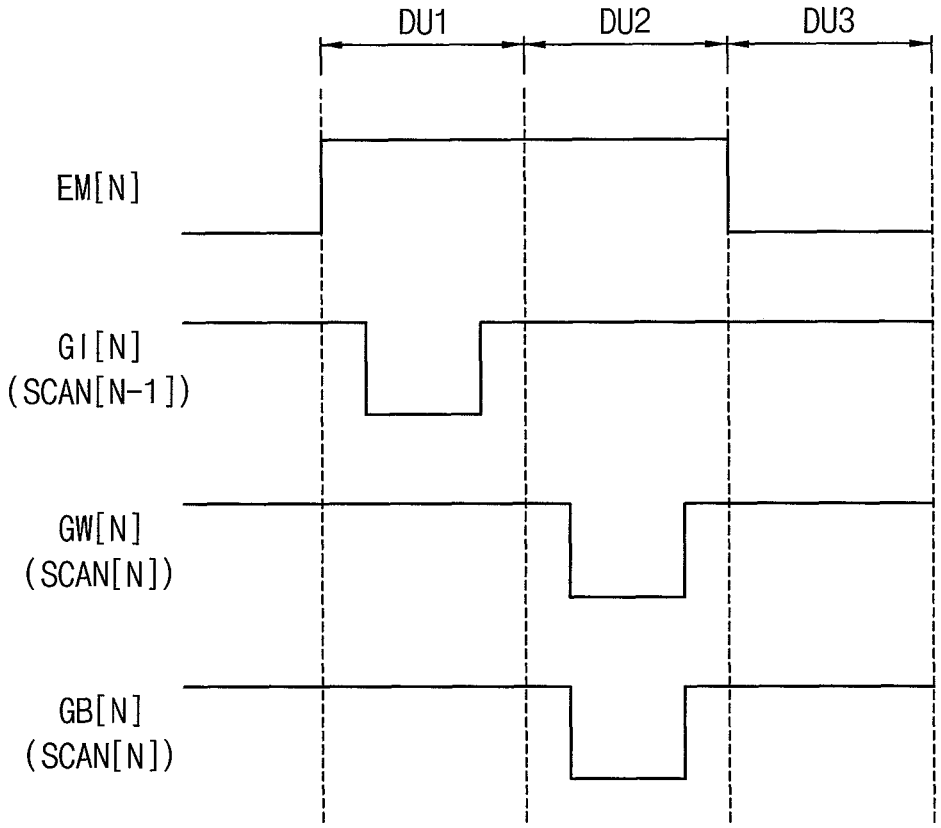
FIG. 5 is a timing diagram illustrating input signals applied to the pixel of FIG. 4.

FIG. 4 is a circuit diagram illustrating a pixel of the display panel 100 of FIG. 3. FIG. 5 is a timing diagram illustrating input signals applied to the pixel of FIG. 4.

Referring to FIGS. 1 to 5, the display panel 100 includes a plurality of pixels. Each pixel includes an organic light emitting element OLED.

The pixel receives a data write gate signal GW, a data initialization gate signal GI, an organic light emitting element initialization gate signal GB, the data voltage VDATA and the emission signal EM. The organic light emitting element OLED of the pixel emits light corresponding to the level of the data voltage VDATA to display the image.

At least one of the pixels may include first to seventh pixel switching elements T1 to T7, a storage capacitor CST and the organic light emitting element OLED.

The first pixel switching element T1 includes a control electrode connected to a first node N1, an input electrode connected to a second node N2 and an output electrode connected to a third node N3.

For example, the first pixel switching element T1 may be a P-type thin film transistor. The control electrode of the first pixel switching element T1 may be a gate electrode. The input electrode of the first pixel switching element T1 may be a source electrode. The output electrode of the first pixel switching element T1 may be a drain electrode.

The second pixel switching element T2 includes a control electrode receiving the data write gate signal GW, an input electrode receiving the data voltage VDATA and an output electrode connected to the second node N2.

For example, the second pixel switching element T2 may be the P-type thin film transistor. The control electrode of the second pixel switching element T2 may be a gate electrode. The input electrode of the second pixel switching element T2 may be a source electrode. The output electrode of the second pixel switching element T2 may be a drain electrode.

The third pixel switching element T3 includes a control electrode receiving the data write gate signal GW, an input electrode connected to the first node N1 and an output electrode connected to the third node N3.

For example, the third pixel switching element T3 may be the P-type thin film transistor. The control electrode of the third pixel switching element T3 may be a gate electrode. The input electrode of the third pixel switching element T3 may be a source electrode. The output electrode of the third pixel switching element T3 may be a drain electrode.

The fourth pixel switching element T4 includes a control electrode receiving the data initialization gate signal GI, an input electrode receiving an initialization voltage VI and an output electrode connected to the first node N1.

For example, the fourth pixel switching element T4 may be the P-type thin film transistor. The control electrode of the fourth pixel switching element T4 may be a gate electrode. The input electrode of the fourth pixel switching element T4 may be a source electrode. The output electrode of the fourth pixel switching element T4 may be a drain electrode.

The fifth pixel switching element T5 includes a control electrode receiving the emission signal EM, an input electrode receiving a high power voltage ELVDD and an output electrode connected to the second node N2.

For example, the fifth pixel switching element T5 may be the P-type thin film transistor. The control electrode of the fifth pixel switching element T5 may be a gate electrode. The input electrode of the fifth pixel switching element T5 may be a source electrode. The output electrode of the fifth pixel switching element T5 may be a drain electrode.

The sixth pixel switching element T6 includes a control electrode receiving the emission signal EM, an input electrode connected to the third node N3 and an output electrode connected to an anode electrode of the organic light emitting element OLED.

For example, the sixth pixel switching element T6 may be the P-type thin film transistor. The control electrode of the sixth pixel switching element T6 may be a gate electrode, the input electrode of the sixth pixel switching element T6 may be a source electrode and the output electrode of the sixth pixel switching element T6 may be a drain electrode.

According to some example embodiments, the sixth pixel switching element T6 of the first display area DA1 may include a back gate electrode receiving the back gate voltage VBML. The sixth pixel switching element T6 of the second display area DA2 may not include the back gate electrode. The sixth pixel switching element T6 may have a back gate structure. The pixel switching element of the back gate structure may include a gate electrode and an additional gate electrode (the back gate electrode).

Although the sixth pixel switching element T6 of the first display area DA1 includes the back gate electrode according to some example embodiments, embodiments according to the present inventive concept are not limited thereto. At least one of the first to seventh pixel switching elements T1 to T7 may include the back gate electrode.

The seventh pixel switching element T7 includes a control electrode receiving the organic light emitting element initialization gate signal GB, an input electrode receiving the initialization voltage VI and an output electrode connected to the anode electrode of the organic light emitting element OLED.

For example, the seventh pixel switching element T7 may be a P-type thin film transistor. The control electrode of the seventh pixel switching element T7 may be a gate electrode, the input electrode of the seventh pixel switching element T7 may be a source electrode and the output electrode of the seventh pixel switching element T7 may be a drain electrode.

The storage capacitor CST includes a first electrode receiving the high power voltage ELVDD and a second electrode connected to the first node N1.

The organic light emitting element OLED includes the anode electrode and a cathode electrode receiving a low power voltage ELVSS.

In FIG. 5, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the data write gate signal GW. During the second duration DU2, the anode electrode of the organic light emitting element OLED is initialized in response to the organic light emitting element initialization gate signal GB. During a third duration DU3, the organic light emitting element OLED emit the light in response to the emission signal EM so that the display panel 100 displays the image.

During the first duration DU1, the data initialization gate signal GI may have an active level. For example, the active level of the data initialization gate signal GI may be a low level. When the data initialization gate signal GI has the active level, the fourth pixel switching element T4 is turned on so that the initialization voltage VI may be applied to the first node N1. The data initialization gate signal GI[N] of a present stage may be generated based on a scan signal SCAN[N−1] of a previous stage.

During the second duration DU2, the data write gate signal GW may have an active level. For example, the active level of the data write gate signal GW may be a low level. When the data write gate signal GW has the active level, the second pixel switching element T2 and the third pixel switching element T3 are turned on. In addition, the first pixel switching element T1 is turned on in response to the initialization voltage VI. The data write gate signal GW[N] of the present stage may be generated based on a scan signal SCAN[N] of the present stage.

A voltage which is subtraction an absolute value |VTH| of the threshold voltage of the first pixel switching element T1 from the data voltage VDATA may be charged at the first node N1 along a path generated by the first to third pixel switching elements T1, T2 and T3 which are turned on.

During the second duration DU2, the organic light emitting element initialization gate signal GB may have an active level. For example, the active level of the organic light emitting element initialization gate signal GB may be a low level. When the organic light emitting element initialization gate signal GB has the active level, the seventh pixel switching element T7 is turned on so that the initialization voltage VI may be applied to the anode electrode of the organic light emitting element OLED. The organic light emitting element initialization gate signal GB[N] of the present stage may be generated based on the scan signal SCAN[N] of the present stage.

Although the active timing of the organic light emitting element initialization gate signal GB is the same as the active timing of the data write gate signal GW in the present example embodiment, embodiments according to the present inventive concept are not limited thereto. Alternatively, the active timing of the organic light emitting element initialization gate signal GB may be same as the active timing of the data initialization gate signal GI. Alternatively, the active timing of the organic light emitting element initialization gate signal GB may be different from the active timing of the data write gate signal GW and the active timing of the data initialization gate signal GI.

During the third duration DU3, the emission signal EM may have an active level. The active level of the emission signal EM may be a low level. When the emission signal EM has the active level, the fifth pixel switching element T5 and the sixth pixel switching element T6 are turned on. In addition, the first pixel switching element T1 is turned on by the data voltage VDATA.

A driving current flows through the fifth pixel switching element T5, the first pixel switching element T1 and the sixth pixel switching element T6 to drive the organic light emitting element OLED. An intensity of the driving current may be determined by the level of the data voltage VDATA. A luminance of the organic light emitting element OLED is determined by the intensity of the driving current. The driving current ISD flowing through a path from the input electrode to the output electrode of the first pixel switching element T1 is determined as following Equation 1.

$$ISD = \frac{1}{2}\mu Cox\frac{W}{L}(VSG - |VTH|)^2 \quad \text{Equation 1}$$

In Equation 1, p is a mobility of the first pixel switching element T1. Cox is a capacitance per unit area of the first pixel switching element T1. W/L is a width to length ratio of the first pixel switching element T1. VSG is a voltage between the input electrode N2 of the first pixel switching element T1 and the control node N1 of the first pixel switching element T1. |VTH| is the threshold voltage of the first pixel switching element T1.

The voltage VG of the first node N1 after the compensation of the threshold voltage |VTH| during the second duration DU2 may be represented as following Equation 2.

$$VG = VDATA - |VTH| \quad \text{Equation 2:}$$

When the organic light emitting element OLED emits the light during the third duration DU3, the driving voltage VOV and the driving current ISD may be represented as following Equations 3 and 4. In Equation 3, VS is a voltage of the second node N2.

$$VOV = VS - VG - |VTH| = ELVDD - (VDATA - |VTH|) - |VTH| = ELVDD - VDATA \quad \text{Equation 3}$$

-continued $$ISD = \frac{1}{2}\mu Cox\frac{W}{L}(ELVDD - VDATA)^2 \quad \text{Equation 4}$$

The threshold voltage |VTH| is compensated during the second duration DU2, so that the driving current ISD may be determined regardless of the threshold voltage |VTH| of the first pixel switching element T1 when the organic light emitting element OLED emits the light during the third duration DU3.

Figure 6:
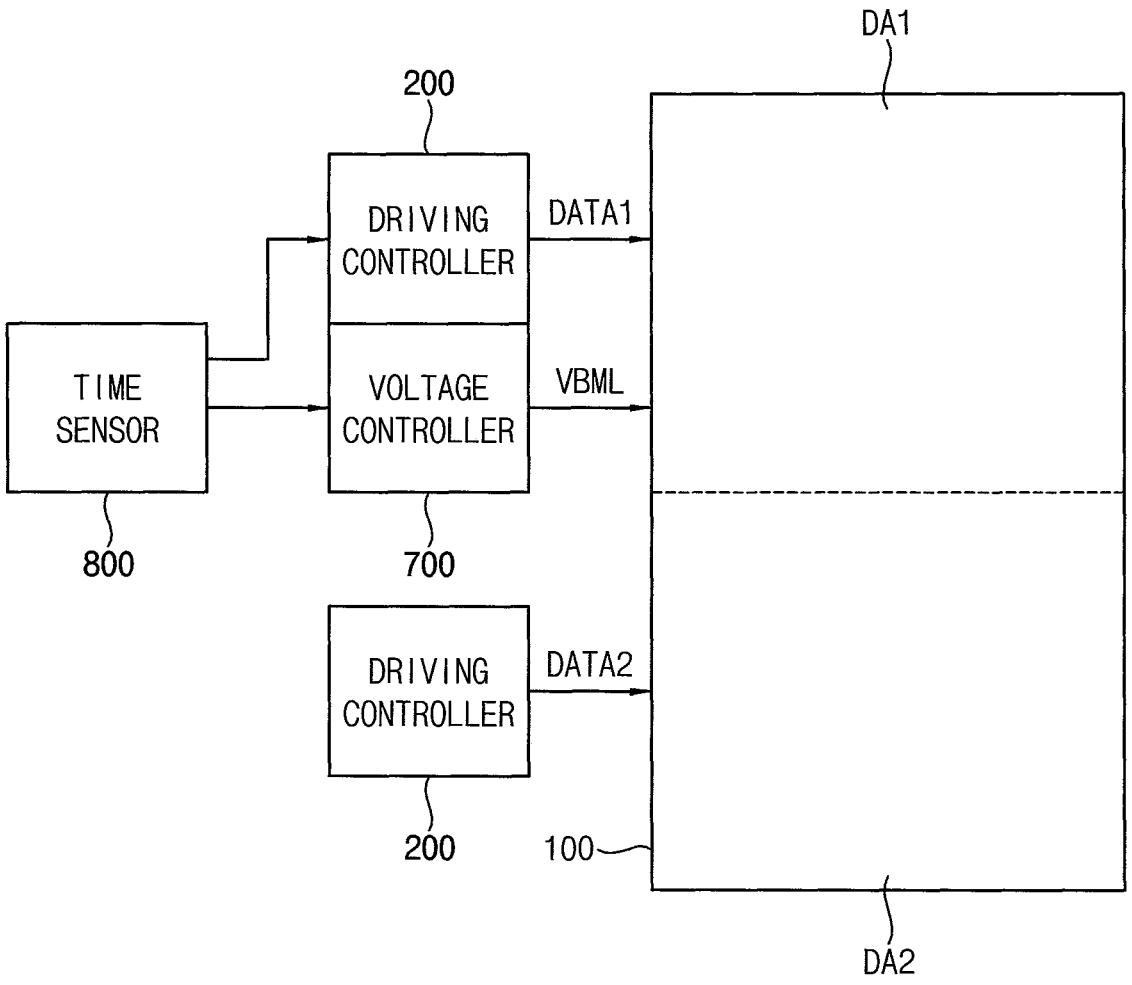
FIG. 6 is a conceptual diagram illustrating operations of a driving controller, a voltage controller and a time sensor of FIG. 1.
Figure 7:
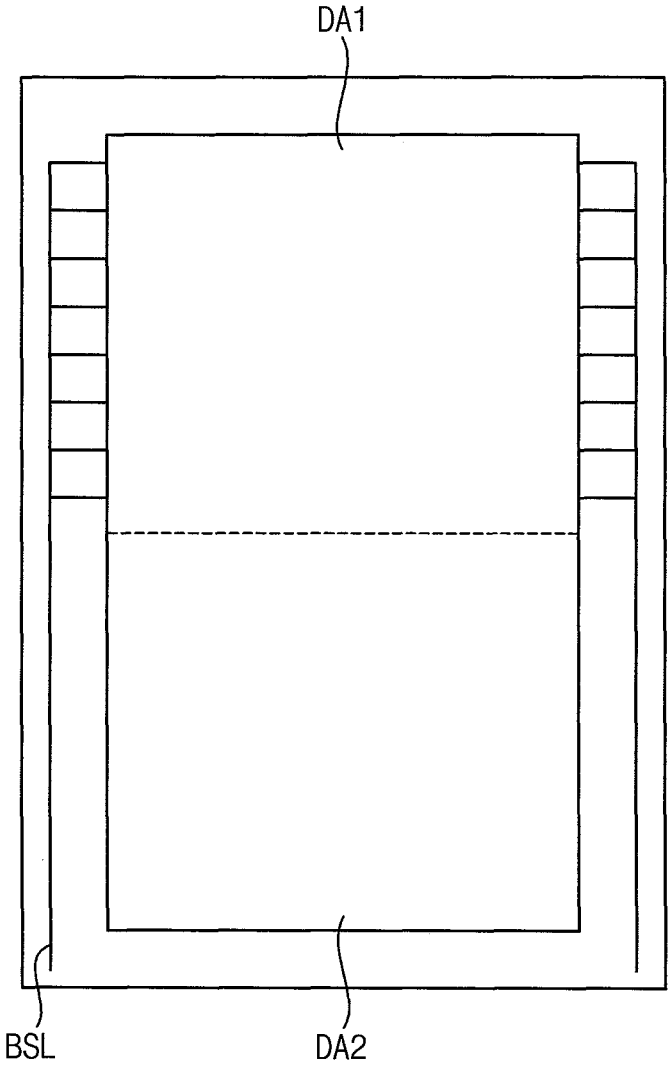
FIG. 7 is a conceptual diagram illustrating a first display area, a second display area and a back gate signal applying line of the display panel of FIG. 3.
Figure 8:
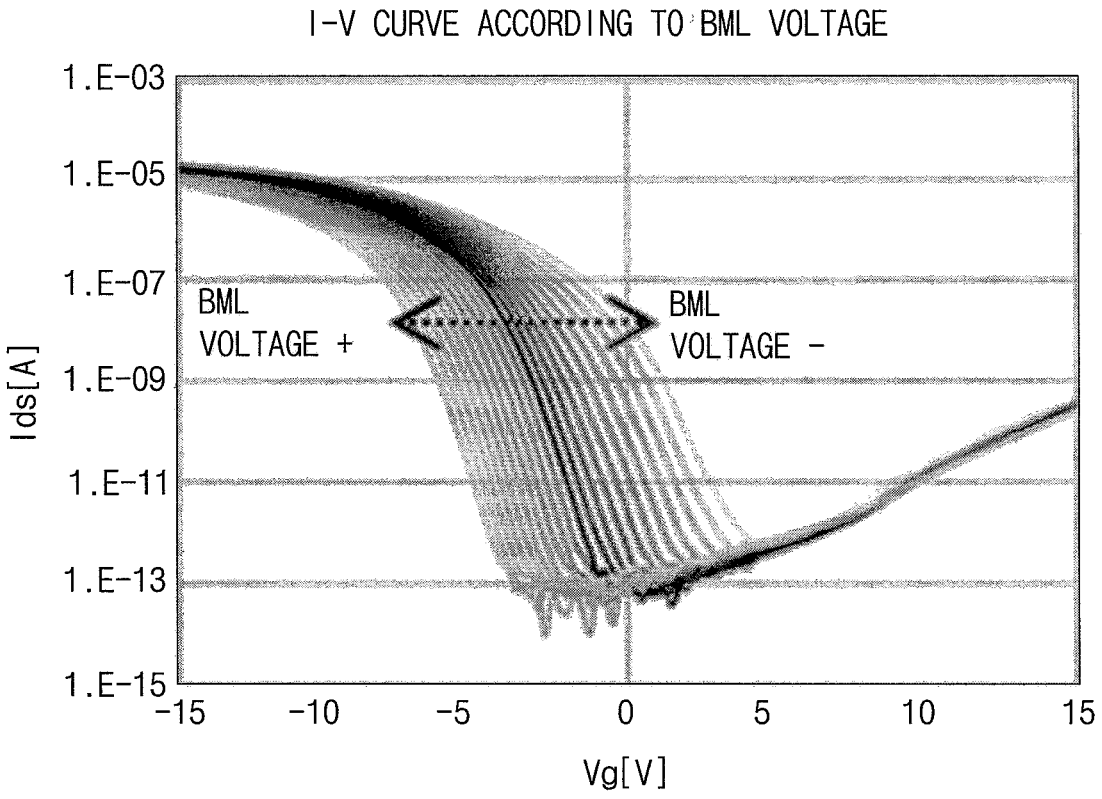
FIG. 8 is a graph illustrating a current voltage curve of a sixth pixel switching element of FIG. 4 according to a level of a back gate voltage.

FIG. 6 is a conceptual diagram illustrating operations of the driving controller 200, the voltage controller 700 and the time sensor 800 of FIG. 1. FIG. 7 is a conceptual diagram illustrating a first display area DA1, a second display area DA2 and a back gate signal applying line BSL of the display panel of FIG. 3. FIG. 8 is a graph illustrating a current voltage curve of the sixth pixel switching element T6 of FIG. 4 according to a level of a back gate voltage.

Referring to FIGS. 1 to 8, the time sensor 800 senses the operation time of the display panel 100. The voltage controller 700 adjusts the back gate voltage VBML according to the operation time sensed by the time sensor 800 and the display areas DA1 and DA2.

The driving controller 200 may generate a first data signal DATA1 corresponding to the first display area DA1 and a second data signal DATA2 corresponding to the second display area DA2.

According to some example embodiments, the pixels in the first display area DA1 may include the back gate electrodes and the pixels in the second display area DA2 may not include the back gate electrodes. The display panel 100 may include a back gate signal applying line BSL connected to the back gate electrodes of the pixels in the first display area DA1. The back gate signal applying line BSL may be connected to the pixels in the first display area DA1. The back gate signal applying line BSL may not be connected to the pixels in the second display area DA2.

The voltage controller 700 may adjust the back gate voltage VBML according to the operation time. The voltage controller 700 may apply the back gate voltage VBML to the back gate electrode in the first display area DA1.

When the operation time of the pixel of the display panel 100 increases, a threshold voltage of the pixel switching element is shifted so that the pixel may not display a desired image. To compensate a shift of the threshold voltage of the pixel switching element, the back gate voltage VBML may be applied to the back gate electrode of the pixel switching element.

As shown in FIG. 8, when the back gate voltage VBML is shifted in a positive direction, the current Ids of the pixel switching element decreases for the same gate voltage Vg. When the back gate voltage VBML is shifted in a negative direction, the current Ids of the pixel switching element increases for the same gate voltage Vg.

Thus, when the operation time of the pixel increases, the voltage controller 700 may decrease the back gate voltage VBML which is applied to the back gate electrode in the first display area DA1.

According to some example embodiments, the back gate voltage VBML may be applied to only some (e.g. DA1) of the display areas DA1 and DA2 for the display panel 100 including the plural display areas DA1 and DA2 so that the difference of deterioration among the display areas DA1 and DA2 due to the difference of the driving time among the display areas DA1 and DA2 may be compensated so that the display quality of the display panel 100 may be enhanced.

Figure 9:
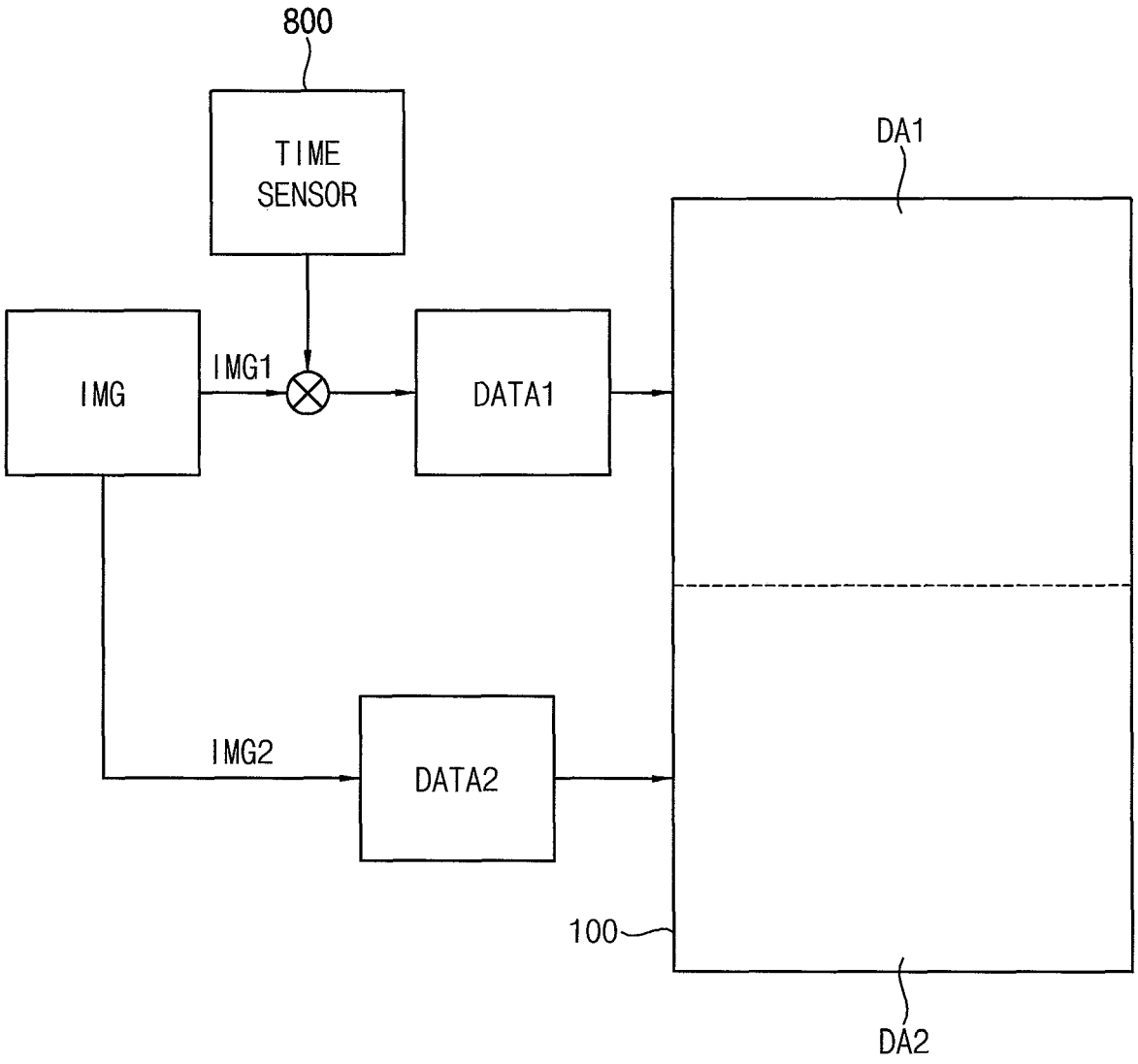
FIG. 9 is a conceptual diagram illustrating operations of a driving controller and a time sensor of a display apparatus according to some example embodiments of the present inventive concept.

FIG. 9 is a conceptual diagram illustrating operations of a driving controller and a time sensor of a display apparatus according to some example embodiments of the present inventive concept.

The display apparatus and the method of driving the display panel according to the present example embodiment is substantially the same as the display apparatus and the method of driving the display panel of the previous example embodiment explained referring to FIGS. 1 to 8 except for the operations of the driving controller and the time sensor. Thus, the same reference numerals will be used to refer to the same or like parts as those described in the previous example embodiment of FIGS. 1 to 8 and some repetitive explanation concerning the above elements may be omitted.

Referring to FIGS. 1 to 9, the display apparatus includes a display panel 100 and a display panel driver. The display panel driver includes a driving controller 200, a gate driver 300, a gamma reference voltage generator 400, a data driver 500 and an emission driver 600. The display panel driver further includes a voltage controller 700 and a time sensor 800.

According to some example embodiments, the display panel 100 may include a first display area DA1, a second display area DA2 and a back gate signal applying line BSL connected to back gate electrodes of pixels in the first display area DA1.

The time sensor 800 senses the operation time of the display panel 100. The voltage controller 700 adjusts the back gate voltage VBML according to the operation time sensed by the time sensor 800 and the display areas DA1 and DA2.

The driving controller 200 may divide input image data IMG into first image data IMG1 corresponding to the first display area DA1 and second image data IMG2 corresponding to the second display area DA2. The driving controller 200 may compensate only the first image data IMG1 among the first image data IMG1 and the second image data IMG2 based on the operation time sensed by the time sensor 800.

The driving controller 200 compensates the first image data IMG1 and generates a first data signal DATA1 corresponding to the first display area DA1 based on the compensated first image data. The driving controller 200 generates a second data signal DATA2 corresponding to the second display area DA2 based on the second image data IMG2.

The data driver 500 may convert the first data signal DATA1 to a first data voltage having an analog type and output the first data voltage to the first display area DA1. The data driver 500 may convert the second data signal DATA2 to a second data voltage having an analog type and output the second data voltage to the second display area DA2.

According to some example embodiments, the back gate voltage VBML may be applied to only some (e.g. DA1) of the display areas DA1 and DA2 for the display panel 100 including the plural display areas DA1 and DA2 and the image data (e.g. IMG1) corresponding to only some (e.g. DA1) of the display areas DA1 and DA2 are compensated so that the difference of deterioration among the display areas DA1 and DA2 due to the difference of the driving time among the display areas DA1 and DA2 may be compensated so that the display quality of the display panel 100 may be enhanced.

Figure 10:
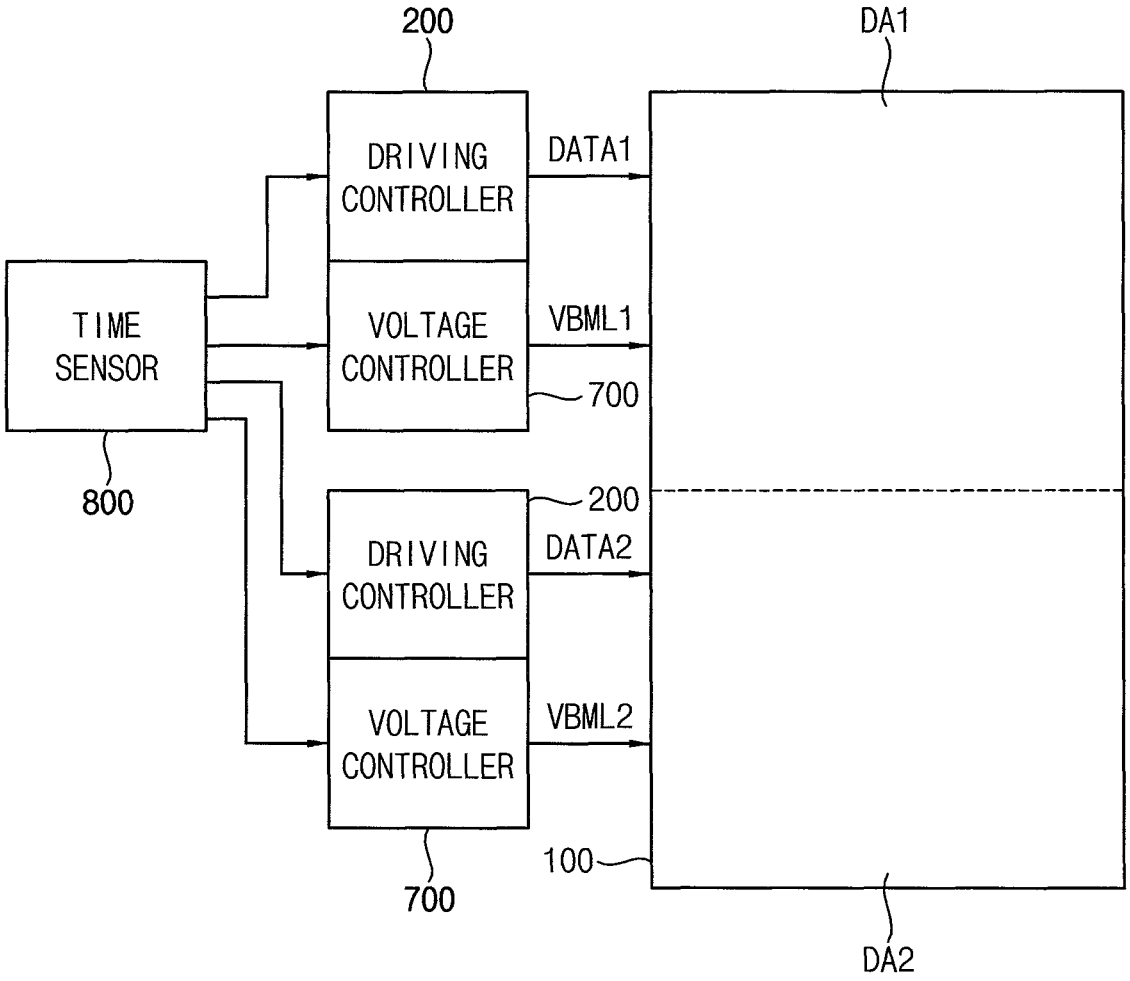
FIG. 10 is a conceptual diagram illustrating operations of a driving controller, a voltage controller and a time sensor of a display apparatus according to some example embodiments of the present inventive concept.
Figure 11:
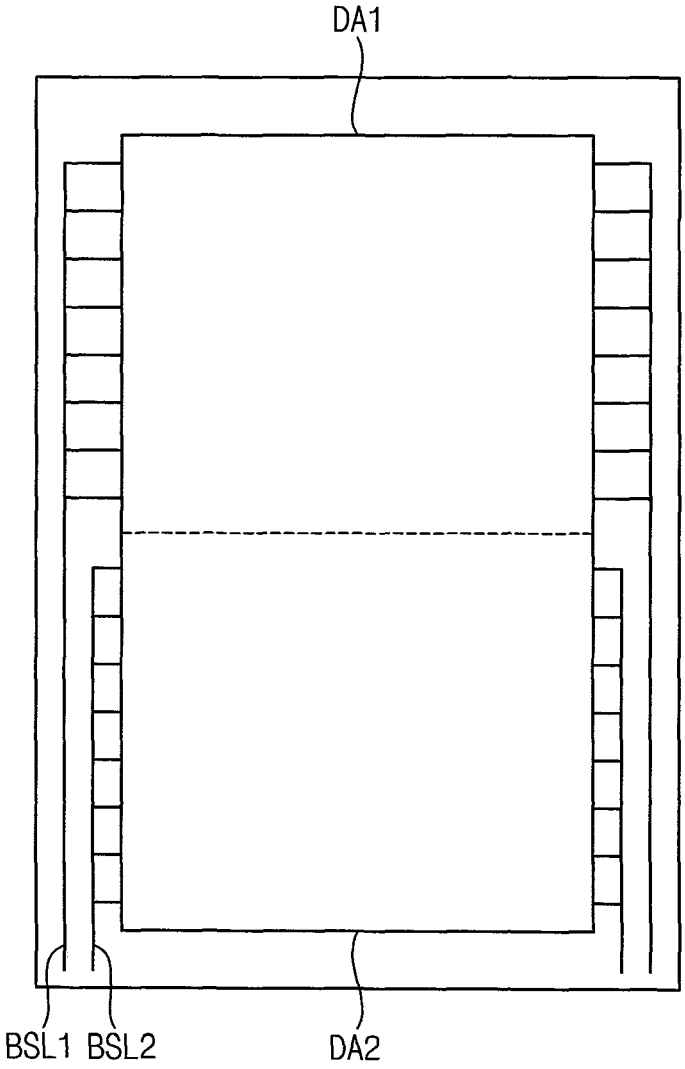
FIG. 11 is a conceptual diagram illustrating a first display area, a second display area, a first back gate signal applying line and a second back gate signal applying line of a display panel of the display apparatus of FIG. 10.

FIG. 10 is a conceptual diagram illustrating operations of a driving controller 200, a voltage controller 700 and a time sensor 800 of a display apparatus according to some example embodiments of the present inventive concept. FIG. 11 is a conceptual diagram illustrating a first display area DA1, a second display area DA2, a first back gate signal applying line BSL1 and a second back gate signal applying line BSL2 of a display panel 100 of the display apparatus of FIG. 10.

The display apparatus and the method of driving the display panel according to the present example embodiment is substantially the same as the display apparatus and the method of driving the display panel of the previous example embodiment explained referring to FIGS. 1 to 8 except that the back gate electrodes are respectively formed in the first display area and the second display area and different back gate voltages are applied to the first display area and the second display area. Thus, the same reference numerals will be used to refer to the same or like parts as those described in the previous example embodiment of FIGS. 1 to 8 and some repetitive explanation concerning the above elements may be omitted.

Referring to FIGS. 1 to 5, 10 and 11, the display apparatus includes a display panel 100 and a display panel driver. The display panel driver includes a driving controller 200, a gate driver 300, a gamma reference voltage generator 400, a data driver 500 and an emission driver 600. The display panel driver further includes a voltage controller 700 and a time sensor 800.

According to some example embodiments, the display panel 100 may include a first display area DA1, a second display area DA2, a first back gate signal applying line BSL1 connected to first back gate electrodes of pixels in the first display area DA1 and a second back gate signal applying line BSL2 connected to second back gate electrodes of pixels in the second display area DA2.

According to some example embodiments, the sixth pixel switching element T6 in the first display area DA1 may further include a back gate electrode receiving a first back gate voltage VBML1. According to some example embodiments, the sixth pixel switching element T6 in the second display area DA2 may further include a back gate electrode receiving a second back gate voltage VBML2.

Although the sixth pixel switching elements T6 in the first display area DA1 and the second display area DA2 include the back gate electrodes in the present example embodiment, embodiments according to the present inventive concept are not limited thereto. At least one of the first to seventh pixel switching elements T1 to T7 in the first display area DA1 and the second display area DA2 may include the back gate electrodes.

The voltage controller 700 may output the first back gate voltage VBML1 to the first back gate signal applying line BSL1 and the second back gate voltage VBML2 to the second back gate signal applying line BSL2.

The voltage controller 700 may adjust the first back gate voltage VBML1 according to the operation time of the first display area DA1 sensed by the time sensor 800. The voltage controller 700 may adjust the second back gate voltage VBML2 according to the operation time of the second display area DA2 sensed by the time sensor 800.

The time sensor 800 senses the operation time of the display panel 100. According to some example embodiments, the time sensor 800 may independently sense the operation time of the first display area DA1 of the display panel 100 and the operation time of the second display area DA2 of the display panel 100.

The driving controller 200 may generate a first data signal DATA1 corresponding to the first display area DA1 and a second data signal DATA2 corresponding to the second display area DA2.

According to some example embodiments, the first back gate electrodes may be formed in the pixels in the first display area DA1 and the second back gate electrodes may be formed in the pixels in the second display area DA2. The first back gate electrodes of the pixels in the first display area DA1 may be connected to each other. The second back gate electrodes of the pixels in the second display area DA2 may be connected to each other. The display panel 100 may include a first back gate signal applying line BSL1 connected to the first back gate electrodes of the pixels in the first display area DA1. The first back gate signal applying line BSL1 may be connected to the pixels in the first display area DA1. The first back gate signal applying line BSL1 may not be connected to the pixels in the second display area DA2. The display panel 100 may include a second back gate signal applying line BSL2 connected to the second back gate electrodes of the pixels in the second display area DA2. The second back gate signal applying line BSL2 may be connected to the pixels in the second display area DA2. The second back gate signal applying line BSL2 may not be connected to the pixels in the first display area DA1.

The voltage controller 700 may adjust the first back gate voltage VBML1 according to the operation time of the first display area DA1. The voltage controller 700 may apply the first back gate voltage VBML1 to the first back gate electrodes in the first display area DA1. The voltage controller 700 may adjust the second back gate voltage VBML2 according to the operation time of the second display area DA2. The voltage controller 700 may apply the second back gate voltage VBML2 to the second back gate electrodes in the second display area DA2. Herein, the operation time of the first display area DA1 may be different from the operation time of the second display area DA2. Thus, the first back gate voltage VBML1 may be different from the second back gate voltage VBML2.

When the operation time of the first display area DA1 increases, the voltage controller 700 may decrease the first back gate voltage VBML1. When the operation time of the second display area DA2 increases, the voltage controller 700 may decrease the second back gate voltage VBML2.

When the operation time of the pixel of the display panel 100 increases, a threshold voltage of the pixel switching element is shifted so that the pixel may not display a desired image. When the operation of the pixel of the first display area DA1 is extremely different from the operation of the pixel of the second display area DA2, the difference of deterioration between the first display area DA1 and the second display area DA2 may be generated. Thus, the different back gate voltages may be applied to the first display area DA1 and the second display area DA2.

For example, when the operation time of the first display area DA1 is greater than the operation time of the second display area DA2, the first back gate voltage VBML1 may be less than the second back gate voltage VBML2.

When the operation time of the pixel of in the first display area DA1 increases, the voltage controller 700 may decrease the first back gate voltage VBML1 which is applied to the first back gate electrode in the first display area DA1. When the operation time of the pixel of in the second display area DA2 increases, the voltage controller 700 may decrease the second back gate voltage VBML2 which is applied to the second back gate electrode in the second display area DA2.

According to some example embodiments, the different back gate voltages VBML1 and VBML2 may be applied to the display areas DA1 and DA2 for the display panel 100 including the plural display areas DA1 and DA2 so that the difference of deterioration among the display areas DA1 and DA2 due to the difference of the driving time among the display areas DA1 and DA2 may be compensated so that the display quality of the display panel 100 may be enhanced.

Figure 12:
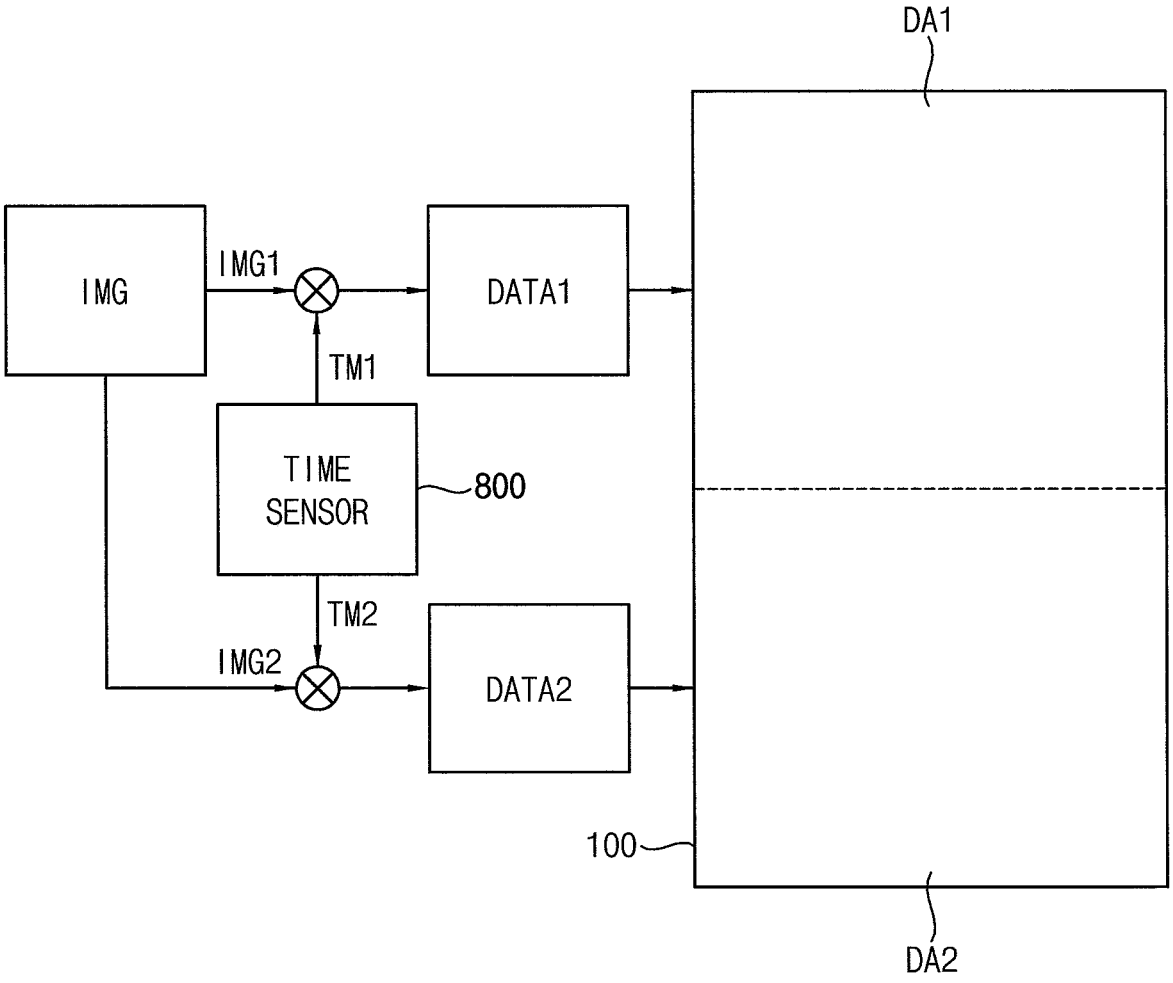
FIG. 12 is a conceptual diagram illustrating operations of a driving controller and a time sensor of a display apparatus according to some example embodiments of the present inventive concept.

FIG. 12 is a conceptual diagram illustrating operations of a driving controller 200 and a time sensor 800 of a display apparatus according to some example embodiments of the present inventive concept.

The display apparatus and the method of driving the display panel according to the present example embodiment is substantially the same as the display apparatus and the method of driving the display panel of the previous example embodiment explained referring to FIGS. 10 and 11 except for the operations of the driving controller and the time sensor. Thus, the same reference numerals will be used to refer to the same or like parts as those described in the previous example embodiment of FIGS. 10 and 11 and some repetitive explanation concerning the above elements may be omitted.

Referring to FIGS. 1 to 5 and 10 to 12, the display apparatus includes a display panel 100 and a display panel driver. The display panel driver includes a driving controller 200, a gate driver 300, a gamma reference voltage generator 400, a data driver 500 and an emission driver 600. The display panel driver further includes a voltage controller 700 and a time sensor 800.

According to some example embodiments, the display panel 100 may include a first display area DA1, a second display area DA2, a first back gate signal applying line BSL1 connected to first back gate electrodes of pixels in the first display area DA1 and a second back gate signal applying line BSL2 connected to second back gate electrodes of pixels in the second display area DA2.

The voltage controller 700 may output the first back gate voltage VBML1 to the first back gate signal applying line BSL1 and the second back gate voltage VBML2 to the second back gate signal applying line BSL2.

The voltage controller 700 may adjust the first back gate voltage VBML1 according to a first operation time TM1 of the first display area DA1 sensed by the time sensor 800. The voltage controller 700 may adjust the second back gate voltage VBML2 according to a second operation time TM2 of the second display area DA2 sensed by the time sensor 800.

The time sensor 800 senses the operation time of the display panel 100. According to some example embodiments, the time sensor 800 may independently sense the first operation time TM1 of the first display area DA1 of the display panel 100 and the second operation time TM2 of the second display area DA2 of the display panel 100.

The driving controller 200 may divide input image data IMG into first image data IMG1 corresponding to the first display area DA1 and second image data IMG2 corresponding to the second display area DA2. The driving controller 200 may compensate the first image data IMG1 based on the first operation time TM1 of the first display area DA1 sensed by the time sensor 800. The driving controller 200 may compensate the second image data IMG2 based on the second operation time TM2 of the second display area DA2 sensed by the time sensor 800.

The driving controller 200 compensates the first image data IMG1 based on the first operation time TM1 and generates a first data signal DATA1 corresponding to the first display area DA1 based on the compensated first image data. The driving controller 200 compensates the second image data IMG2 based on the second operation time TM2 and generates a second data signal DATA2 corresponding to the second display area DA2 based on the compensated second image data.

The data driver 500 may convert the first data signal DATA1 to a first data voltage having an analog type and output the first data voltage to the first display area DA1. The data driver 500 may convert the second data signal DATA2 to a second data voltage having an analog type and output the second data voltage to the second display area DA2.

According to some example embodiments, the different back gate voltages VBML1 and VBML2 may be applied to the display areas DA1 and DA2 for the display panel 100 including the plural display areas DA1 and DA2 and the image data IMG1 and IMG2 corresponding to the display areas DA1 and DA2 are compensated differently so that the difference of deterioration among the display areas DA1 and DA2 due to the difference of the driving time among the display areas DA1 and DA2 may be compensated so that the display quality of the display panel 100 may be enhanced.

Figure 13:
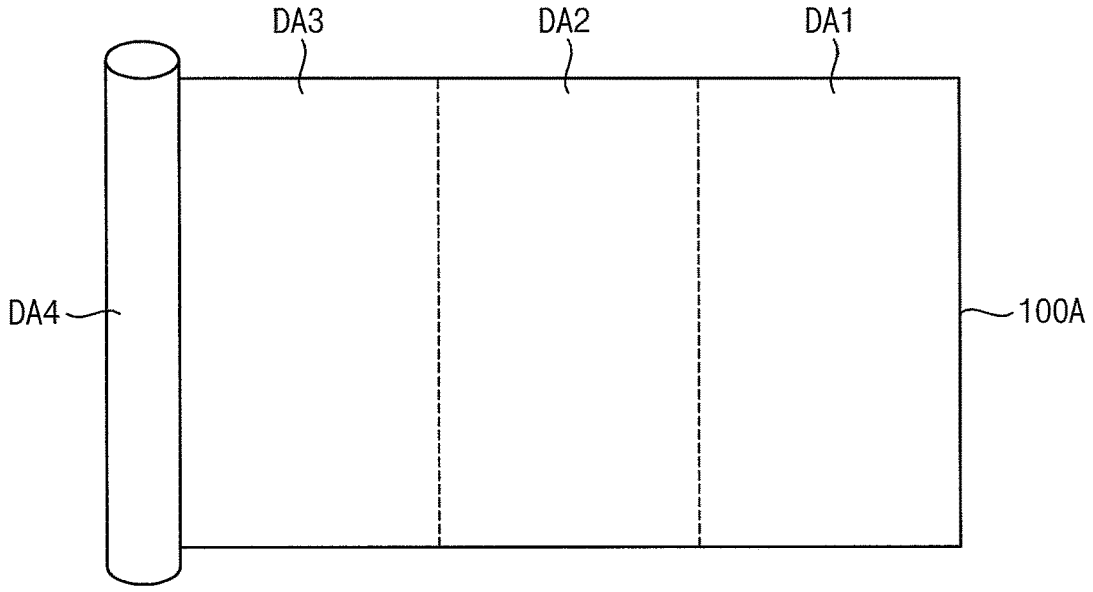
FIG. 13 is a perspective view illustrating a display apparatus according to some example embodiments of the present inventive concept.
Figure 14:
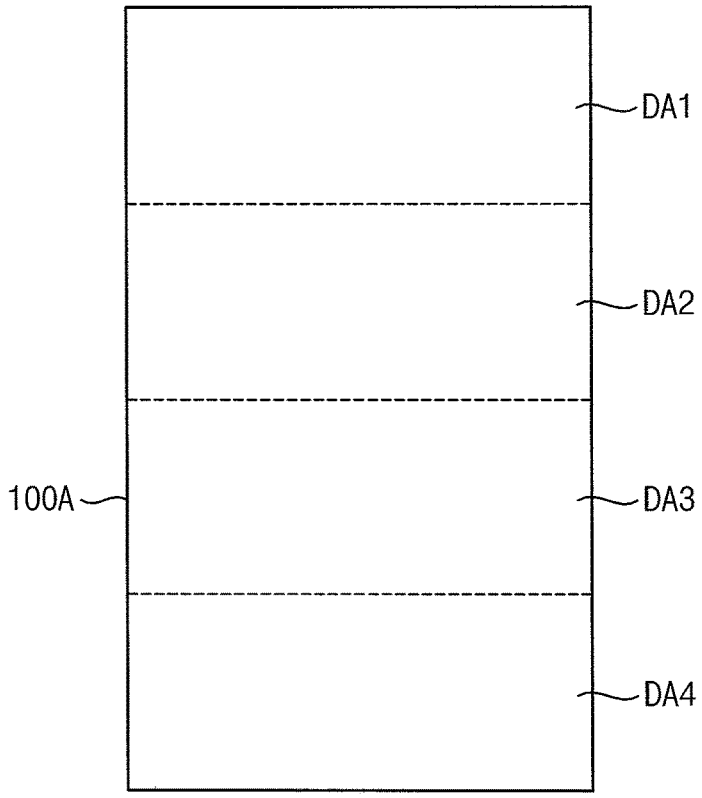
FIG. 14 is a plan view illustrating a display panel of FIG. 13.
Figure 15:
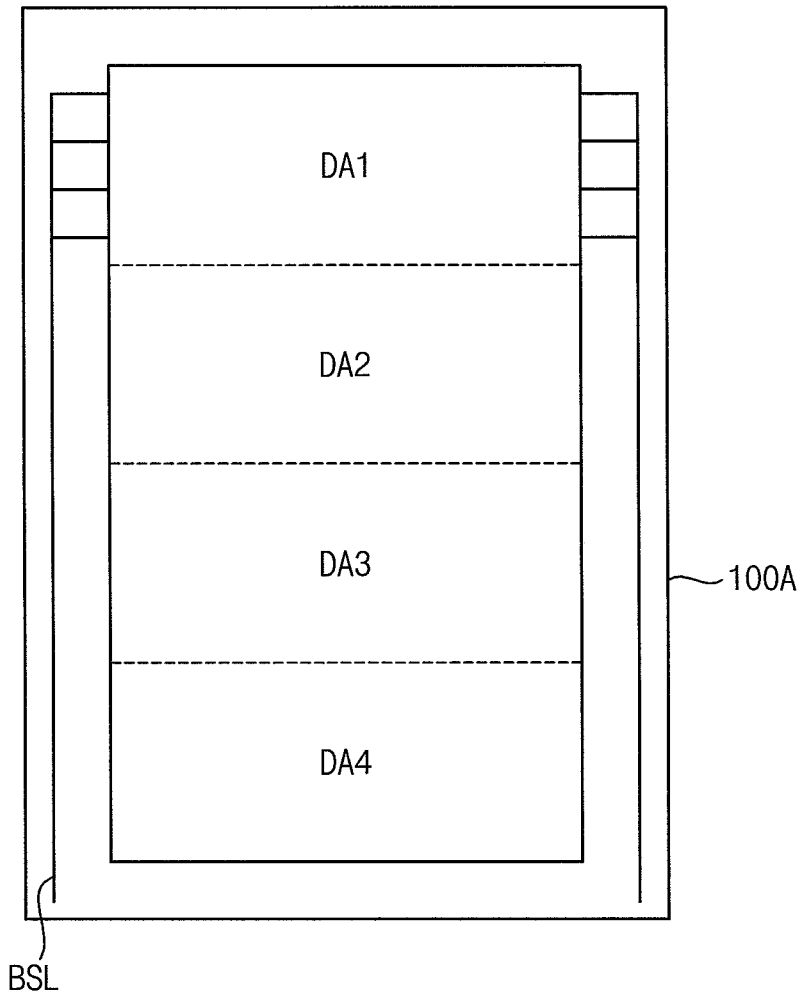
FIG. 15 is a conceptual diagram illustrating first to fourth display areas and a back gate signal applying line of the display panel of FIG. 14.

FIG. 13 is a perspective view illustrating a display apparatus according to some example embodiments of the present inventive concept. FIG. 14 is a plan view illustrating a display panel 100A of FIG. 13. FIG. 15 is a conceptual diagram illustrating first to fourth display areas and a back gate signal applying line of the display panel 100A of FIG. 14.

The display apparatus and the method of driving the display panel according to the present example embodiment is substantially the same as the display apparatus and the method of driving the display panel of the previous example embodiment explained referring to FIGS. 1 to 9 except that the display apparatus is the rollable display apparatus. Thus, the same reference numerals will be used to refer to the same or like parts as those described in the previous example embodiment of FIGS. 1 to 9 and some repetitive explanation concerning the above elements may be omitted.

Referring to FIGS. 3 to 5 and 13 to 15, the display apparatus includes a flexible display panel 100A. The display apparatus may be the rollable display apparatus. The display panel 100A may be wound around a roll.

The display panel 100A may include a plurality of display areas. For example, the display panel 100A may include three or more display areas. The display areas may not be visually distinguished. Although the display panel 100A includes four display areas in the present example embodiment, embodiments according to the present inventive concept are not limited to the number of the display areas illustrated.

For example, an outermost display area from the roll may be a first display area DA1. A display area adjacent to the first display area DA1 and closer to the roll than the first display area DA1 may be a second display area DA2. A display area adjacent to the second display area DA2 and closer to the roll than the second display area DA2 may be a third display area DA3. A display area adjacent to the third display area DA3 and closer to the roll than the third display area DA3 may be a fourth display area DA4.

When the display apparatus is operated as shown in FIG. 13, the first to third display areas DA1, DA2 and DA3 may display an image and the fourth display area DA4 may not display an image. According to a used status of the display apparatus, all of the first to fourth display areas DA1, DA2, DA3 and DA4 may display an image. According to a used status of the display apparatus, the first and second display areas DA1 and DA2 may display an image and the third and fourth display areas DA3 and DA4 may not display an image. According to a used status of the display apparatus, the first display area DA1 may display an image and the second to fourth display areas DA2, DA3 and DA4 may not display an image.

Thus, the first display area DA1 may display an image most frequently and the fourth display area DA4 may display an image least frequently.

The display apparatus includes a display panel 100A and a display panel driver. The display panel driver includes a driving controller 200, a gate driver 300, a gamma reference voltage generator 400, a data driver 500 and an emission driver 600. The display panel driver further includes a voltage controller 700 and a time sensor 800.

According to some example embodiments, the display panel 100A may include first to fourth display areas DA1, DA2, DA3 and DA4 and back gate signal applying line BSL connected to back gate electrodes of pixels in the first display area DA1.

According to some example embodiments, the pixels in the first display area DA1 may include the back gate electrodes and the pixels in the second to fourth display areas DA2, DA3 and DA4 may not include the back gate electrodes. The back gate signal applying line BSL may be connected to the pixels in the first display area DA1. The back gate signal applying line BSL may not be connected to the pixels in the second to fourth display areas DA2, DA3 and DA4.

The voltage controller 700 may adjust the back gate voltage VBML according to the operation time. The voltage controller 700 may apply the back gate voltage VBML to the back gate electrode in the first display area DA1.

When the operation time of the pixel increases, the voltage controller 700 may decrease the back gate voltage VBML which is applied to the back gate electrode in the first display area DA1.

In addition, similarly to FIG. 9, the driving controller 200 may divide the input image data IMG into first image data corresponding to the first display area DA1, second image data corresponding to the second display area DA2, third image data corresponding to the third display area DA3 and fourth image data corresponding to the fourth display area DA4. The driving controller 200 may compensate only the first image data among the first to fourth image data based on the operation time sensed by the time sensor 800.

According to some example embodiments, the back gate voltage VBML may be applied to only some (e.g. DA1) of the display areas DA1, DA2, DA3 and DA4 for the display panel 100A including the plural display areas DA1, DA2, DA3 and DA4 so that the difference of deterioration among the display areas DA1, DA2, DA3 and DA4 due to the difference of the driving time among the display areas DA1, DA2, DA3 and DA4 may be compensated so that the display quality of the display panel 100A may be enhanced.

Figure 16:
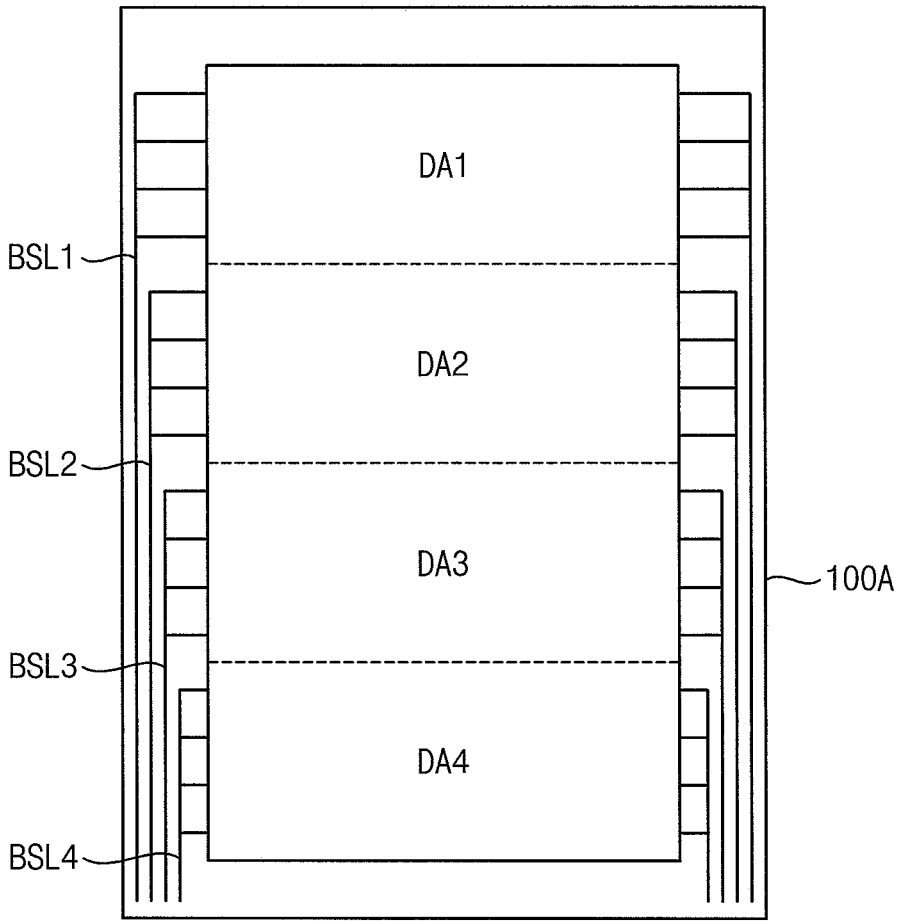
FIG. 16 is a conceptual diagram illustrating first to fourth display areas and first to fourth back gate signal applying lines of a display panel according to some example embodiments of the present inventive concept.

FIG. 16 is a conceptual diagram illustrating first to fourth display areas DA1, DA2, DA3 and DA4 and first to fourth back gate signal applying lines BSL1, BSL2, BSL3 and BSL4 of a display panel 100A according to some example embodiments of the present inventive concept.

The display apparatus and the method of driving the display panel according to the present example embodiment is substantially the same as the display apparatus and the method of driving the display panel of the previous example embodiment explained referring to FIGS. 14 and 15 except that the back gate electrodes are respectively formed in the first to fourth display areas and different back gate voltages are applied to the first to fourth display areas. Thus, the same reference numerals will be used to refer to the same or like parts as those described in the previous example embodiment of FIGS. 14 and 15 and some repetitive explanation concerning the above elements may be omitted.

Referring to FIGS. 3 to 5 and 16, the display apparatus includes a display panel 100A and a display panel driver. The display panel driver includes a driving controller 200, a gate driver 300, a gamma reference voltage generator 400, a data driver 500 and an emission driver 600. The display panel driver further includes a voltage controller 700 and a time sensor 800.

According to some example embodiments, the display panel 100A may include a first to fourth display areas DA1, DA2, DA3 and DA4, a first back gate signal applying line BSL1 connected to first back gate electrodes of pixels in the first display area DA1, a second back gate signal applying line BSL2 connected to second back gate electrodes of pixels in the second display area DA2, a third back gate signal applying line BSL3 connected to third back gate electrodes of pixels in the third display area DA3 and a fourth back gate signal applying line BSL4 connected to fourth back gate electrodes of pixels in the fourth display area DA4.

According to some example embodiments, the first back gate electrodes may be formed in the pixels in the first display area DA1, the second back gate electrodes may be formed in the pixels in the second display area DA2, the third back gate electrodes may be formed in the pixels in the third display area DA3 and the fourth back gate electrodes may be formed in the pixels in the fourth display area DA4. The first back gate electrodes of the pixels in the first display area DA1 may be connected to each other. The second back gate electrodes of the pixels in the second display area DA2 may be connected to each other. The third back gate electrodes of the pixels in the third display area DA3 may be connected to each other. The fourth back gate electrodes of the pixels in the fourth display area DA4 may be connected to each other. The first back gate signal applying line BSL1 may be connected to the pixels in the first display area DA1. The first back gate signal applying line BSL1 may not be connected to the pixels in the second to fourth display areas DA2, DA3 and DA4. The second back gate signal applying line BSL2 may be connected to the pixels in the second display area DA2. The second back gate signal applying line BSL2 may not be connected to the pixels in the first, third and fourth display areas DA1, DA3 and DA4. The third back gate signal applying line BSL3 may be connected to the pixels in the third display area DA3. The third back gate signal applying line BSL3 may not be connected to the pixels in the first, second and fourth display areas DA1, DA2 and DA4. The fourth back gate signal applying line BSL4 may be connected to the pixels in the fourth display area DA4. The fourth back gate signal applying line BSL4 may not be connected to the pixels in the first to third display areas DA1, DA2 and DA3.

The voltage controller 700 may adjust the first back gate voltage according to the operation time of the first display area DA1. The voltage controller 700 may apply the first back gate voltage to the first back gate electrodes in the first display area DA1. The voltage controller 700 may adjust the second back gate voltage according to the operation time of the second display area DA2. The voltage controller 700 may apply the second back gate voltage to the second back gate electrodes in the second display area DA2. The voltage controller 700 may adjust the third back gate voltage according to the operation time of the third display area DA3. The voltage controller 700 may apply the third back gate voltage to the third back gate electrodes in the third display area DA3. The voltage controller 700 may adjust the fourth back gate voltage according to the operation time of the fourth display area DA4. The voltage controller 700 may apply the fourth back gate voltage to the fourth back gate electrodes in the fourth display area DA4. Herein, the operation time of the first display area DA1, the operation time of the second display area DA2, the operation time of the third display area DA3 and the operation time of the fourth display area DA4 may be different from one another. Thus, the first back gate voltage VBML1, the second back gate voltage VBML2, the third back gate voltage VBML3 and the fourth back gate voltage VBML4 may be different from one another.

For example, the operation time of the first display area DA1 may be greater than the operation time of the second display area DA2, the operation time of the second display area DA2 may be greater than the operation time of the third display area DA3, the operation time of the third display area DA3 may be greater than the operation time of the fourth display area DA4 according to the characteristics of the rollable display panel 100A.

For example, when the operation time of the first display area DA1 is greater than the operation time of the second display area DA2, the first back gate voltage may be less than the second back gate voltage. For example, when the operation time of the second display area DA2 is greater than the operation time of the third display area DA3, the second back gate voltage may be less than the third back gate voltage. For example, when the operation time of the third display area DA3 is greater than the operation time of the fourth display area DA4, the third back gate voltage may be less than the fourth back gate voltage.

In addition, similarly to FIG. 12, the driving controller 200 may divide the input image data IMG into first image data corresponding to the first display area DA1, second image data corresponding to the second display area DA2, third image data corresponding to the third display area DA3 and fourth image data corresponding to the fourth display area DA4. The driving controller 200 may compensate the first image data based on the first operation time of the first display area DA1 sensed by the time sensor 800, the second image data based on the second operation time of the second display area DA2 sensed by the time sensor 800, the third image data based on the third operation time of the third display area DA3 sensed by the time sensor 800 and the fourth image data based on the fourth operation time of the fourth display area DA4 sensed by the time sensor 800.

According to some example embodiments, the different back gate voltages may be applied to the display areas DA1, DA2, DA3 and DA4 for the display panel 100A including the plural display areas DA1, DA2, DA3 and DA4 so that the difference of deterioration among the display areas DA1, DA2, DA3 and DA4 due to the difference of the driving time among the display areas DA1, DA2, DA3 and DA4 may be compensated so that the display quality of the display panel 100A may be enhanced.

According to the present inventive concept as explained above, the display quality of the foldable display apparatus and the rollable display apparatus may be enhanced.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and characteristics of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A display apparatus comprising:

a display panel comprising a gate line, a data line and a plurality of display areas;

a gate driver configured to output a gate signal to the gate line;

a data driver configured to output a data voltage to the data line;

a time sensor configured to sense an operation time of the display panel; and a voltage controller configured to adjust a back gate voltage according to the operation time sensed by the time sensor and the display areas.

2. The display apparatus of claim 1, wherein the display areas comprise a first display area and a second display area, wherein a pixel in the first display area comprises a back gate electrode, and wherein a pixel in the second display area does not comprise the back gate electrode.

3. The display apparatus of claim 2, wherein the voltage controller is configured to adjust the back gate voltage according to the operation time and apply the back gate voltage to the back gate electrode in the first display area.

4. The display apparatus of claim 3, wherein when the operation time increases, the voltage controller is configured to decrease the back gate voltage applied to the back gate electrode in the first display area.

5. The display apparatus of claim 2, wherein at least one of the pixels in the first display area comprises:

a first pixel switching element comprising a control electrode connected to a first node, an input electrode connected to a second node, and an output electrode connected to a third node;

a second pixel switching element comprising a control electrode configured to receive a data write gate signal, an input electrode configured to receive the data voltage, and an output electrode connected to the second node;

a third pixel switching element comprising a control electrode configured to receive the data write gate signal, an input electrode connected to the first node, and an output electrode connected to the third node;

a fourth pixel switching element comprising a control electrode configured to receive a data initialization gate signal, an input electrode configured to receive an initialization voltage, and an output electrode connected to the first node;

a fifth pixel switching element comprising a control electrode configured to receive an emission signal, an input electrode configured to receive a high power voltage, and an output electrode connected to the second node;

a sixth pixel switching element comprising a control electrode configured to receive the emission signal, an input electrode connected to the third node, and an output electrode connected to an anode electrode of an organic light emitting element;

a seventh pixel switching element comprising a control electrode configured to receive an organic light emitting element initialization gate signal, an input electrode configured to receive the initialization voltage, and an output electrode connected to the anode electrode of the organic light emitting element;

a storage capacitor comprising a first electrode configured to receive the high power voltage and a second electrode connected to the first node; and the organic light emitting element comprising the anode electrode and a cathode electrode configured to receive a low power voltage.

6. The display apparatus of claim 5, wherein the sixth pixel switching element further comprises the back gate electrode.

7. The display apparatus of claim 2, further comprising a driving controller configured to control a driving timing of the gate driver and a driving timing of the data driver, wherein the driving controller is configured to divide input image data into a first image data corresponding to the first display area and a second image data corresponding to the second display area, and wherein the driving controller is configured to compensate only the first image data among the first image data and the second image data based on the operation time.

8. The display apparatus of claim 2, wherein the display areas further comprise a third display area adjacent to the second display area, and wherein a pixel in the third display area does not comprise the back gate electrode.

9. The display apparatus of claim 2, wherein the display panel is a foldable display panel, wherein the first display area is a first surface of the foldable display panel, and wherein the second display area is a second surface of the foldable display panel.

10. The display apparatus of claim 2, wherein the display panel is a rollable display panel, wherein the first display area is an outermost display area from a roll, and wherein the second display area is closer to the roll than the first display area.

11. The display apparatus of claim 10, wherein the display areas further comprise a third display area adjacent to the second display area, and wherein the third display area is closer to the roll than the second display area.

12. The display apparatus of claim 1, wherein the display areas comprise a first display area and a second display area, wherein pixels in the first display area comprise first back gate electrodes connected with each other, and wherein pixels in the second display area comprise second back gate electrodes connected with each other.

13. The display apparatus of claim 12, wherein the voltage controller is configured to adjust a first back gate voltage according to an operation time of the first display area and apply the first back gate voltage to the first back gate electrodes in the first display area, wherein the voltage controller is configured to adjust a second back gate voltage according to an operation time of the second display area and apply the second back gate voltage to the second back gate electrodes in the second display area, and wherein the second back gate voltage is different from the first back gate voltage.

14. The display apparatus of claim 13, wherein the voltage controller is configured to decrease the first back gate voltage based on the operation time of the first display area increasing, and wherein the voltage controller is configured to decrease the second back gate voltage based on the operation time of the second display area increasing.

15. The display apparatus of claim 12, further comprising a driving controller configured to control a driving timing of the gate driver and a driving timing of the data driver, wherein the driving controller is configured to divide input image data into a first image data corresponding to the first display area and a second image data corresponding to the second display area, wherein the driving controller is configured to compensate the first image data based on the operation time of the first display area, and wherein the driving controller is configured to compensate the second image data based on the operation time of the second display area.

16. The display apparatus of claim 12, wherein the display areas further comprise a third display area adjacent to the second display area, and wherein pixels in the third display area comprise third back gate electrodes connected with each other.

17. The display apparatus of claim 12, wherein the display panel is a foldable display panel, wherein the first display area is a first surface of the foldable display panel, and wherein the second display area is a second surface of the foldable display panel.

18. The display apparatus of claim 12, wherein the display panel is a rollable display panel, wherein the first display area is an outermost display area from a roll, and wherein the second display area is closer to the roll than the first display area.

19. The display apparatus of claim 18, wherein the display areas further comprise a third display area adjacent to the second display area, and wherein the third display area is closer to the roll than the second display area.

20. A method of driving a display panel, the method comprising:

outputting a gate signal to a gate line of the display panel comprising a plurality of display areas;

outputting a data voltage to a data line of the display panel;

sensing an operation time of the display panel using a time sensor; and adjusting a back gate voltage according to the operation time sensed by the time sensor and the display areas.

* * * * *